US005378125A

United States Patent [19]

Frank et al.

[11] Patent Number: 5,378,125

[45] Date of Patent: Jan. 3, 1995

[54] DEVICE FOR SUPPLYING FUEL FROM SUPPLY TANK TO INTERNAL COMBUSTION ENGINE OF MOTOR VEHICLE

[75] Inventors: Kurt Frank, Schorndorf-Haubersbronn; Werner Schmid, Tamm; Willi Strohl, Beilstein; Jochen Thoennissen, Stuttgart; Martin Ungerer, Renningen, all of Germany

[73] Assignee: Robert Bosch GmbH, Stuttgart, Germany

[21] Appl. No.: 70,107

[22] Filed: May 28, 1993

[30] Foreign Application Priority Data

Jun. 27, 1992 [DE] Germany ..... 4221184

[51] Int. Cl.[6] ..... F04B 17/00

[52] U.S. Cl. ..... 417/423.3; 417/423.14; 415/55.1

[58] Field of Search ..... 417/423.3, 423.14; 415/55.1, 55.5, 55.6, 169.1

[56] References Cited

U.S. PATENT DOCUMENTS

| | | | |
|---|---|---|---|
| 3,947,149 | 3/1976 | MacManus | 415/213 T |
| 5,080,554 | 1/1992 | Kamimura | 415/55.1 |
| 5,248,223 | 9/1993 | Hill | 417/423.3 |
| 5,265,996 | 11/1993 | Westoff et al. | 415/55.1 |

*Primary Examiner*—Richard A. Bertsch
*Assistant Examiner*—Alfred Basichas
*Attorney, Agent, or Firm*—Michael J. Striker

[57] ABSTRACT

A device for supplying fuel from a supply tank to an internal combustion engine of a motor vehicle, has a pump chamber with end-side chamber walls and also having an inlet opening and an outlet opening, a drive motor, a supply pump having an impeller driven by the drive motor. The impeller rotates in the pump chamber and has a substantially disc-shaped hub part provided on its periphery with a plurality of radially outwardly extending vanes. At least one of the chamber walls in the region of radially outer ends of the vanes has an approximately ring shaped, groove-like supply passage which surrounds a rotary axis of the impeller. The inlet opening opens in a ring region of the pump chamber which is limited on one side by the hub part of the impeller and on the other side by an inner ring edge of the ring-shaped supply passage which surrounds the hub part with a distance from the latter.

12 Claims, 2 Drawing Sheets

DEVICE FOR SUPPLYING FUEL FROM SUPPLY TANK TO INTERNAL COMBUSTION ENGINE OF MOTOR VEHICLE

BACKGROUND OF THE INVENTION

The present invention relates to a device for supplying a fuel from a supply tank to an internal combustion engine of a motor vehicle.

More particularly, it relates to a device of the above mentioned general type which has an electric drive motor through which fuel flows and which drives an impeller of a supply pump rotating in a pump chamber of the aggregate.

Devices for-supplying fuel of the above mentioned general type are known in the art. One such device is disclosed for example in the U.S. Pat. No. 3,947,149. In the aggregate disclosed in this patent, an inlet opening of a pump chamber opens directly in a ring-shaped supply passage which surrounds the axis of rotation of the impeller. Therefore the aspirated medium disturbs the screw shaped circulating movement which is characteristic for side passage pump and therefore reduces the efficiency of the pump.

SUMMARY OF THE INVENTION

Accordingly, it is an object of the present invention to provide a device for supplying fuel from a supply tank to an internal combustion engine which avoids the disadvantages of the prior art.

In keeping with these objects and with others which will become apparent hereinafter, one feature of the present invention resides, briefly stated, in a device for supplying fuel from a supply tank to an internal combustion engine, in which the inlet opening opens in a ring region of the pump chamber which is limited on the one hand by a hub part of the impeller and on the other hand by an inner ring edge of the ring-shaped supply channel which surrounds the hub part with a distance therefrom.

When the device is designed in accordance with the present invention, it has the advantage that the inflowing medium flows from inside into the supply passage and into the pump chamber and then transits into the circulating flow by deviating in the radial direction.

When the device is designed in accordance with the present invention, it avoids the disadvantages of the prior art and provides for the highly advantageous results specified hereinabove.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
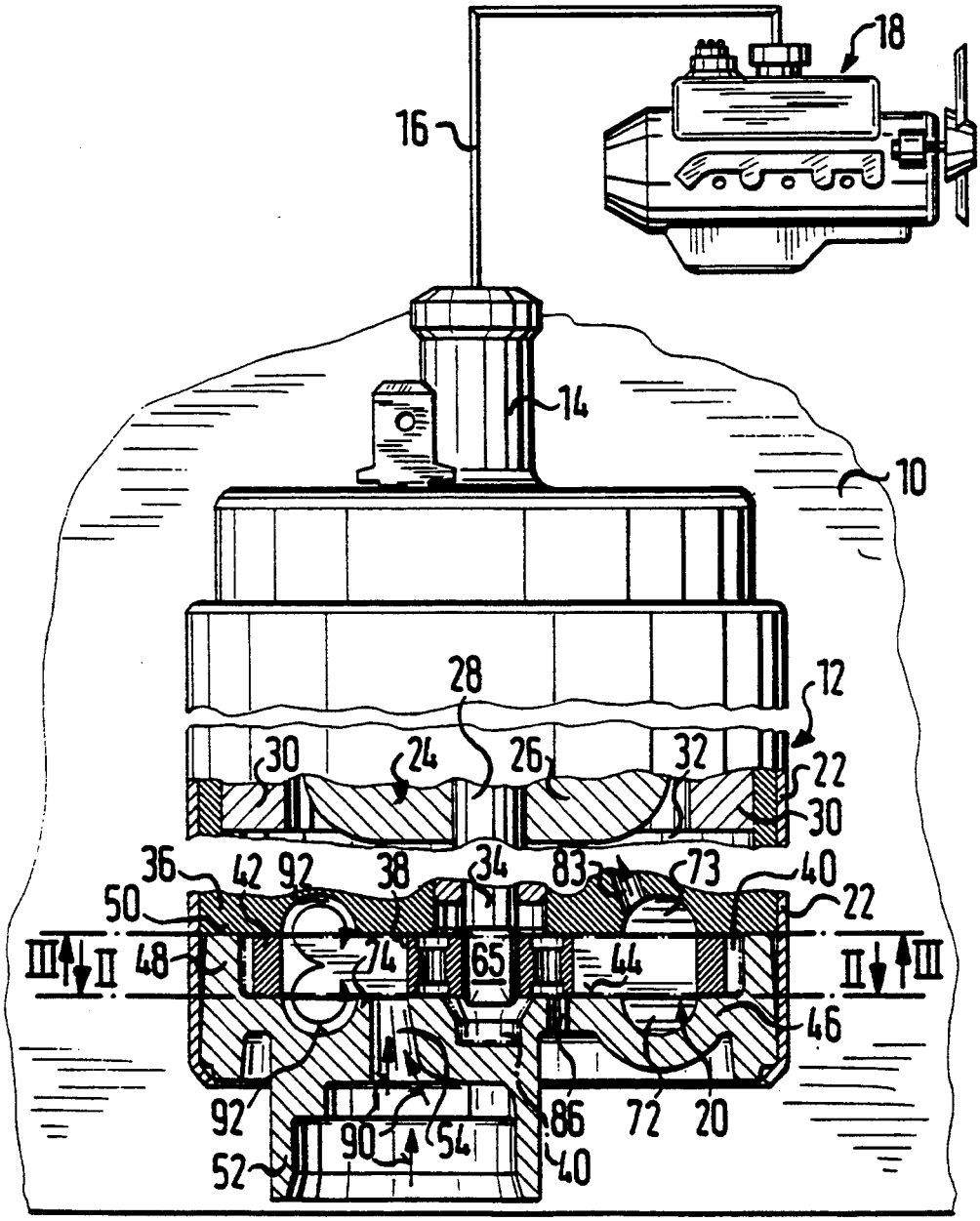
FIG. 1 is a view schematically showing a unit for supplying fuel with a partially sectioned fuel supply device.

A supply device shown in FIG. 1 has a fuel supply tank 10 arranged in a fuel supply device 12. A pressure conduit 16 is connected with a pressure pipe 14 of the fuel supply device 12 and leads to an internal combustion engine 18 of a not shown motor vehicle. During the operation of the internal combustion engine 18, the fuel supply device 12 supplies fuel from the supply tank 10 to the internal combustion engine 18.

The fuel supply device 12 has a first pump stage 20 which can be identified as a pre-supply stage. In the flow direction of the supplied medium, a not shown main or pressure stage is located behind the pre-supply pump 20. It pumps the fuel through the aggregate housing 22 to the pressure pipe 14 and thereby through the pressure conduit 16 to the internal combustion engine 18. The fuel supply device 12 in addition to the pre-supply stage 20 and the not shown pressure stage, also accommodates in its housing 22 an electric drive motor 24. In FIG. 1 a motor armature 26 and an armature shaft 28 of the electric drive motor 24 are shown. A permanent magnet 30 is also a part of the electric motor 24. The electric drive motor 24 is accommodated in a chamber 32 of the supply aggregate 12. The armature shaft 28 extends with its free end 34 through a base plate 36 which is fixedly arranged in the housing 22 and separates the main or pressure stage from the pre-supply stage 20. One wall 38 of the base plate 36 limits in direction of the rotary axis of the armature shaft 34 a pump chamber 40 in which an impeller 42 of the pre-supply stage 20 rotates. The pump chamber 40 is closed, at a distance from the limiting wall 38, with a second limiting wall 44 which is formed on a so-called suction cover 46 and constitutes a part of the aggregate housing.

The suction cover 46 is composed of a synthetic plastic material and provided with a ring edge 48. The height of the ring edge as seen from the limiting wall 44 substantially corresponds to the thickness of the impeller 42. The ring edge 48 abuts with its free end surface 50 against the limiting wall 38. In this way the substantially cylindrical pump chamber 40 is formed. The height of the pump chamber as measured in direction of the rotary axis of the armature shaft 28, substantially corresponds to the thickness of the impeller 42 which is rotatably arranged with a minimal axial play in the pump chamber 40. The suction cover 46 further has a suction pipe 52 facing away of the pump chamber 40 and transiting into an inlet opening 54 to the pump chamber 40. This construction is especially clearly shown in FIG. 2.

Figure 4:
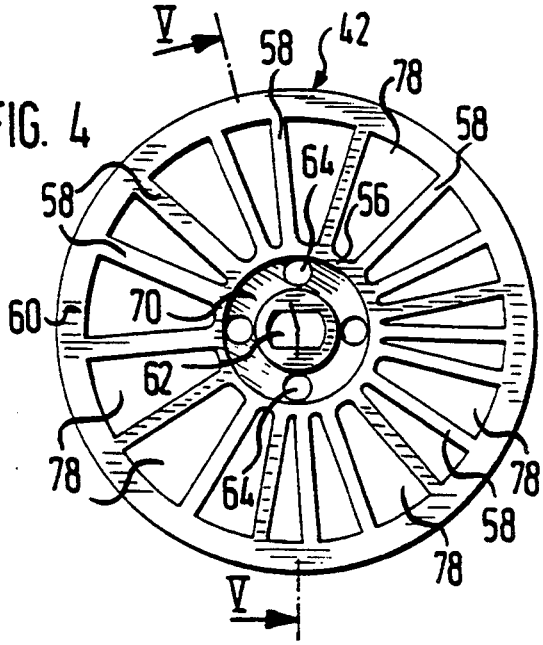
FIG. 4 is a plan of an impeller which is a part of a three supply stage of the fuel supply device of FIG. 1.
Figure 5:
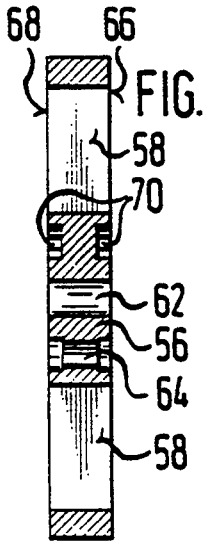
FIG. 5 is a view showing a section through the impeller of FIG. 4 taken along the line V—V.

The construction of the impeller 42 is illustrated in detail in FIG. 4. It can be seen that the impeller has a substantially disc-shaped hub part 56 with a plurality of vanes arranged on its peripheral surface and forming a displacement member of the impeller. The radially outer of the vanes 58 are connected with one another by a ring 60 arranged concentrically to the rotary axis of the impeller 42. The impeller 42 has a central driver passages identified with reference numeral 62. The driver passage 62 has a cross-section corresponding to a so-called two-surface driver 65 arranged on the free end 34 of the armature shaft 28. In FIG. 1 the driver 65 extends into the throughgoing passage 62 of the impeller to provide a form-locking connection. As can be further seen from FIG. 4, the impeller 42 in the hub region 56 has four transverse openings 64 With axis extending substantially parallel to the rotary axis of the impeller 42. The openings 64 are arranged on a circle of the same radius. The mouthes of the openings 14 provided on both end surfaces 66 and 68 of the impeller are located respectively in ring passages 70 arranged in the hub region 56.

As shown in FIG. 1, the impeller 42 is located inside a ring edge 48 of the suction chamber 46. The suction chamber 46 is moreover provided with a ring or side passage 72 which is formed as a groove and substantially surrounds the rotary axis of the impeller 42. The arrangement of the ring passage 72 is selected so that between the inlet opening 54 and the ring passage 72 a web 74 is provided for direct communication between the inlet opening 54 and the ring passage 72. As can be seen from FIG. 2, in the rotary direction identified with reference numeral 76 of the impeller 42 a ramp-like groove 75 is connected with the inlet opening 54 and its flattens in the direction from the inlet opening 54. The ramp-like groove 75 provided an especially good filling of the inflowing fuel in the supply chamber 78 remaining between two adjoining supply members 58. Both ends of the side passage 72 are separated from one another by a so-called separating surface 79 which limits leakage losses from the pressure side 80 of the side passage 72 to the suction side 82. For the same reason, a projection 84 which is directed to the impeller is arranged in the region of the separating surface 79 on the inner wall 49 of the ring edge 48. The projection extends close to the outer periphery of the ring 60 of the impeller 42.

A so-called ventilation opening 86 is arranged in the suction cover 46. Its radial distance from the rotary axis of the impeller 42 substantially corresponds to the radius of the circle on which the opening 64 of the hub 56 of the impeller 42 are arranged. Therefore the ventilation opening 86 opens in the region of the impeller hub 56 in the pump chamber 40. As can be seen from FIG. 2, an arcuate groove 88 extends from the ventilation opening 86 and substantially coincide with the course of the ring passage 76. As can be seen from FIG. 3 a ring-shaped side passage 73 is also provided in the wall 38 of the base plate 36 and is substantially mirror-symmetrical with respect to the side passage 72 in the suction cover 46. Also, FIG. 3 shows the rotary direction of the impeller 42 with the arrow 76. It can be seen that the base plate 36 has a separating surface 77 which separates the suction side 81 of the ring passage 73 from the pressure side 85 of the side passage 73. Further, as can be seen from FIG. 3, the ring passage 73 has an outlet or pressure opening 83 in the base plate 36 at the pressure-side end of the ring passage. Through this opening the fuel is supplied to the not shown pressure or main pump stage.

Figure 2:
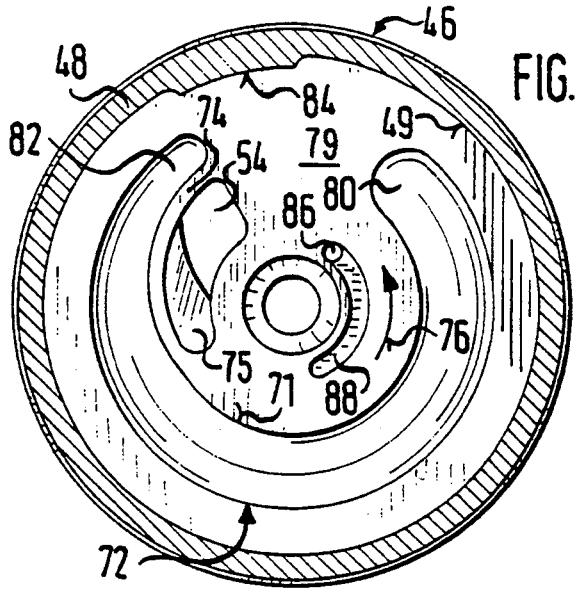
FIG. 2 is a view showing a section taken along the line II—II through a suction cover of the supply device of FIG. 1.
Figure 3:
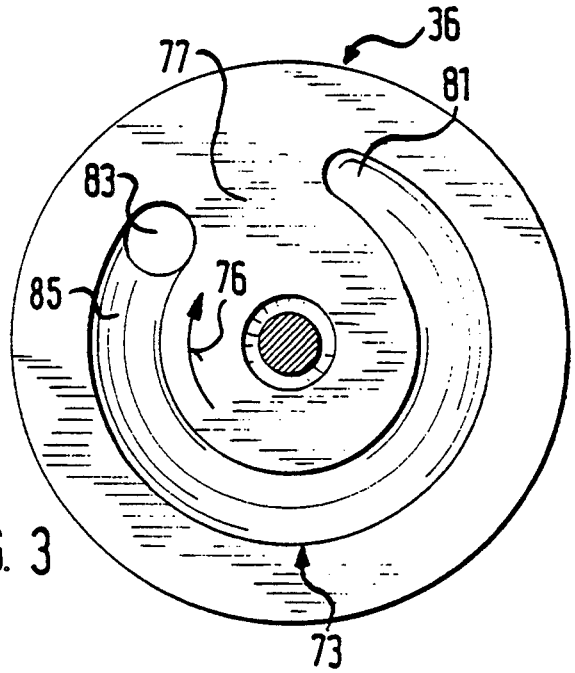
FIG. 3 is a view showing a section taken along the line III—III of the supply device, so that it provides a plan view of a base plate which is a part of the supply aggregate.

As can be seen especially from FIGS. 1 and 2, the inlet opening 54 is located in a ring region of the pump chamber 40 which on one side is limited by the hub part 56 of the impeller 42 and on the other side is limited by the inner edge 71 of the ring-shaped supply passage 72 which surrounds the hub part with a distance from it. As can be further seen from FIG. 1, the ventilation opening 86 of the pump chamber which is provided in the inlet opening-side end wall 34 of the pump chamber is connected with the suction side of the pump, or in other words the ventilation opening 86 opens into the supply tank 10. Further, it can be understood that the ventilation opening 86 as considered in direction of the rotary axis of the impeller 46 is arranged inside the hub 56 of the impeller 42. It can be also seen from FIG. 1 that the supply passages 72 and 73 have at least approximately semi-circular passage bottom over a substantial part of their length.

The supply device in accordance With the present invention operates in the following manner.

The rotating electric drive motor 24 drives through its armature shaft 28, 34 the impeller 42 arranged in the pump chamber 40. Thereby the supply pump. 20 aspirates fuel from the supply tank 10 in direction of the arrow 90 in the pump chamber 40, in which the fuel in a known manner flows in a screw-like circulating stream as identified with the arrow 92 in FIG. 1. It can be clearly recognized from FIG. 1 that the inflowing medium cannot substantially affect the important circulating stream since it enters from inside the supply passage 72, 73 and then transits into the circulating stream being deviated in the radial direction. The separating web 74 contributes to this. The vapor bubbles which are formed in the suction region of the pump are pumped to the rotary axis of the impeller through the small, not visible axial gap between the end side of the impeller 42 and the facing chamber walls 38, 44 until they arrive in the ring passage 70 arranged in the impeller hub 56. The vapor bubbles which accumulate between the impeller 42 and the chamber wall 4 move directly in the groove 88 of the suction cover 46 and from there through the ventilation opening 86 to the tank. The vapor bubbles in an another axial gap between the impeller 42 and the base plate 36 escape through the throughgoing openings 64 of the ring passage 70 and from there into the degassing opening 86. The ring-shaped collecting passage 70 plays an important role during the withdrawal and discharge of the vapor bubbles.

The arrangement of the inlet opening in accordance with the present invention is described with respect to a two-stage side passage pump. However, it can be also used for known one-stage side passage pumps.

It will be understood that each of the elements described above, or two or more together, may also find a useful application in other types of constructions differing from the types described above.

While the invention has been illustrated and described as embodied in a device for supplying fuel from a supply tank to an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for supplying fuel from a supply tank to an internal combustion engine of a motor vehicle, comprising means forming a pump chamber with end-side chamber walls and also having an inlet opening and an outlet opening; a drive motor; a supply pump having an impeller driven by said drive motor, said impeller rotating in said pump chamber and having a substantially disc-shaped hub part provided on its periphery with a plurality of radially outwardly extending vanes, at least one of said chamber walls in the region of radially outer ends of said vanes having an approximately ring shaped, groove-like supply passage which surrounds a rotary axis of said impeller, said inlet opening in a ring region of said pump chamber which is limited radially inwardly by said hub part of said impeller and radially outwardly by an inner ring edge of said ring-shaped supply passage which surrounds said hub part.

2. A device as defined in claim 1, wherein said motor is an electric drive motor through which fuel flows.

3. A device as defined in claim 1, wherein another of said end-side chamber walls is provided with second supply passage which is mirror symmetrical to said ring-shaped, groove-like supply passage.

4. A device as defined in claim 1; and further comprising a ring which connects said radially outer ends of said vanes of said impeller with one another and is arranged concentrically to the axis of rotation of said impeller.

5. A device as defined in claim 1, wherein said chamber has an end wall which is located at the side of said inlet opening and is provided with a ventilating opening which connects said chamber with a suction side of said pump.

6. A device as defined in claim 5, wherein said ventilation opening is arranged inside said hub part as considered in direction of the rotary axis of said impeller.

7. A device as defined in claim 6, wherein said ventilating opening is spaced from a rotary axis of said impeller by a distance, said hub part of said impeller having transverse openings which are located on a circle with a radius equal to said distance from said ventilation opening from said rotary axis of said impeller.

8. A device as defined in claim 7, wherein said hub part has a groove-shaped ring passage which connects said transverse openings with one another.

9. A device as defined in claim 6, wherein one of said chamber walls is provided with a groove which surrounds said rotary axis of said impeller over at least 45°, said ventilation opening having a mouth provided at the side of said chamber and located on said groove.

10. A device as defined in claim 1; and further comprising a web which separates said inlet opening from said supply passage arranged in the same chamber wall.

11. A device as defined in claim 1, wherein said supply passage has at least approximately semi-circular passage bottom over a substantial part of its length.

12. A device as defined in claim 1, wherein said supply pump is formed as a pre-supply stage of a two-stage pump.

* * * * *